United States Patent [19]

deVos et al.

[11] 4,006,354

[45] Feb. 1, 1977

[54] LOW-PROFILE LIGHTING FIXTURE

[75] Inventors: Hendrik A. J. deVos, Swansea; Thomas W. Carvalho, Somerset, both of Mass.

[73] Assignee: GTE Sylvania Incorporated, Stamford, Conn.

[22] Filed: July 9, 1975

[21] Appl. No.: 594,316

[52] U.S. Cl. ..... 240/51.11 R; 240/11.4 R; 240/25

[51] Int. Cl.[2] ..... H05B 33/02; F21V 23/02

[58] Field of Search ..... 240/11.4 R, 25, 41 R, 240/41 B, 41.35 R, 51.11 R, 86, 3, 9, 103 R

[56] References Cited

UNITED STATES PATENTS 3,652,847 3/1972 McFarlin ..... 240/51.11 R

*Primary Examiner*—Russell E. Adams, Jr.
*Attorney, Agent, or Firm*—Peter Xiarhos; Elmer J. Nealon; Norman J. O'Malley

[57] ABSTRACT

A low-profile lighting fixture particularly suitable for low and medium height mounting installations. The lighting fixture includes a housing assembly comprising a base member and first and second end sections at opposite ends of the base member. The first and second end sections respectively contain a power supply ballast transformer and capacitor for the fixture. An upstanding bracket supporting a horizontally-oriented lamp-receiving socket is attached to the base member intermediate to the first and second end sections, and a generally-rectangular reflector having an opening therein is mounted to the base member in line with and intermediate to the first and second end sections with the lamp-receiving socket extending horizontally into the interior of the reflector via the opening in the reflector. The base member and the first and second end sections of the housing assembly have elongated channel openings formed therein for facilitating the assembly of the elements comprising the housing assembly and for facilitating the mounting of the aforementioned power supply components (ballast transformer and capacitor) within the first and second end sections. Channels openings formed in the base member are also used in conjunction with a wire-retaining clip for establishing and orienting the path of wiring associated with the power supply components.

16 Claims, 10 Drawing Figures

LOW-PROFILE LIGHTING FIXTURE

BACKGROUND OF THE INVENTION

In the manufacture of lighting fixtures, particularly industrial-type lighting fixtures for low and medium height mounting installations, it is desirable that the vertical dimensions of such fixtures be made as small as possible so that the fixtures utilize as little of the vertical space of an installation site as possible and, at the same time, interfere as little as possible with existing equipment such as air-conditioning and heating equipment, fire sprinkler systems and plumbing and electrical equipment. In addition, it is desirable that the fixtures comprise as few parts as possible and be easily and quickly assembled to minimize manufacturing costs. The present invention is directed to a lighting fixture which satisfies the above objectives.

BRIEF SUMMARY OF THE INVENTION

Briefly, in accordance with the present invention, a low-profile lighting fixture is provided which includes a generally-flat base member and first and second end sections. The first and second end sections are attached to the base member at first and second ends of the base member, respectively, and define first and second housings, respectively. A power supply ballast transformer is contained within the first housing defined by the first end section and, in a similar manner, a power supply capacitor is contained within the second housing defined by the second end section.

The low-profile lighting fixture of the invention further includes a lamp-receiving socket, a mounting means for the lamp-receiving socket and reflector. The mounting means is attached to the base member adjacent to one of the end sections and positions the lamp-receiving socket in a generally horizontal orientation. The reflector is positioned in line with the first and second end sections, intermediate to the first and second end sections, and has an opening therein. In accordance with the invention, this opening communicates with the interior of the reflector for the projection into the interior of the reflector of the lamp-receiving socket.

BRIEF DESCRIPTION OF THE DRAWING

Various objects, features and advantages of a low-profile lighting fixture in accordance with the present invention will be apparent from the following detailed description taken in conjunction with the accompanying drawing in which.

DETAILED DESCRIPTION OF THE INVENTION

Figure 1:
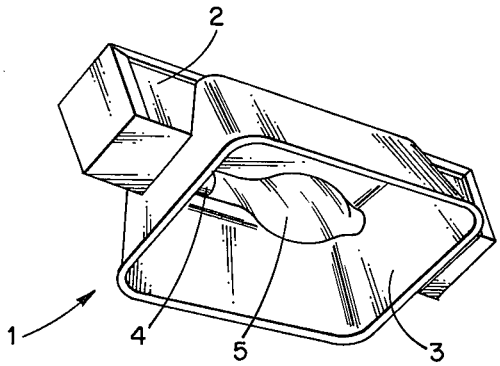
FIGS. 1 and 2 are perspective and front views, respectively, of a low-profile lighting fixture in accordance with the invention as arranged for use in a direct lighting application.
Figure 3:
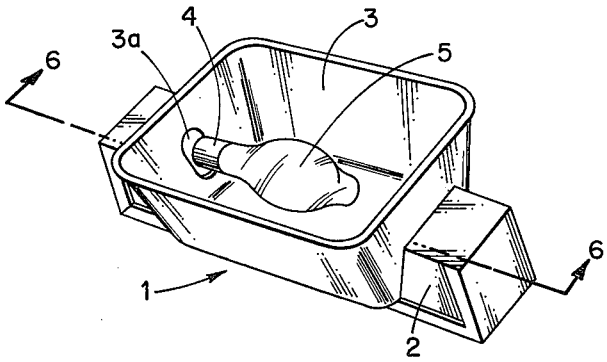
FIGS. 3 and 4 are perspective and front views, respectively, of the lighting fixture of the invention as arranged for use in an indirect lighting application.
Figure 2:
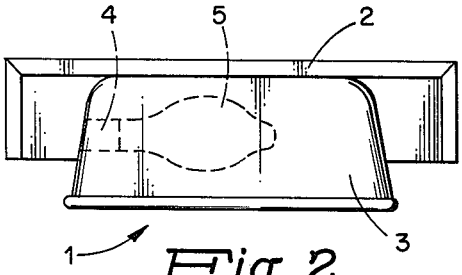
Figure 4:
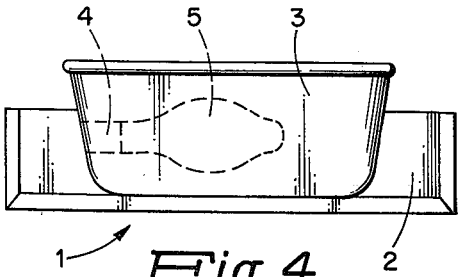

Referring now to FIGS. 1–6, there is shown a low-profile lighting fixture 1 in accordance with the present invention. The lighting fixture 1 may be arranged to illuminate an area with either direct lighting, for example, as shown in FIGS. 1 and 2, or to illuminate an area with indirect lighting, for example, as shown in FIGS. 3 and 4. As shown in FIGS. 1–6, the lighting fixture 1 comprises a housing assembly 2, a generally-rectangular reflector 3 attached to the housing assembly 2, and a screw-type lamp socket 4 extending horizontally through an opening 3*a* in the reflector 3 and arranged to receive a lamp 5.

Figures 5, 7:
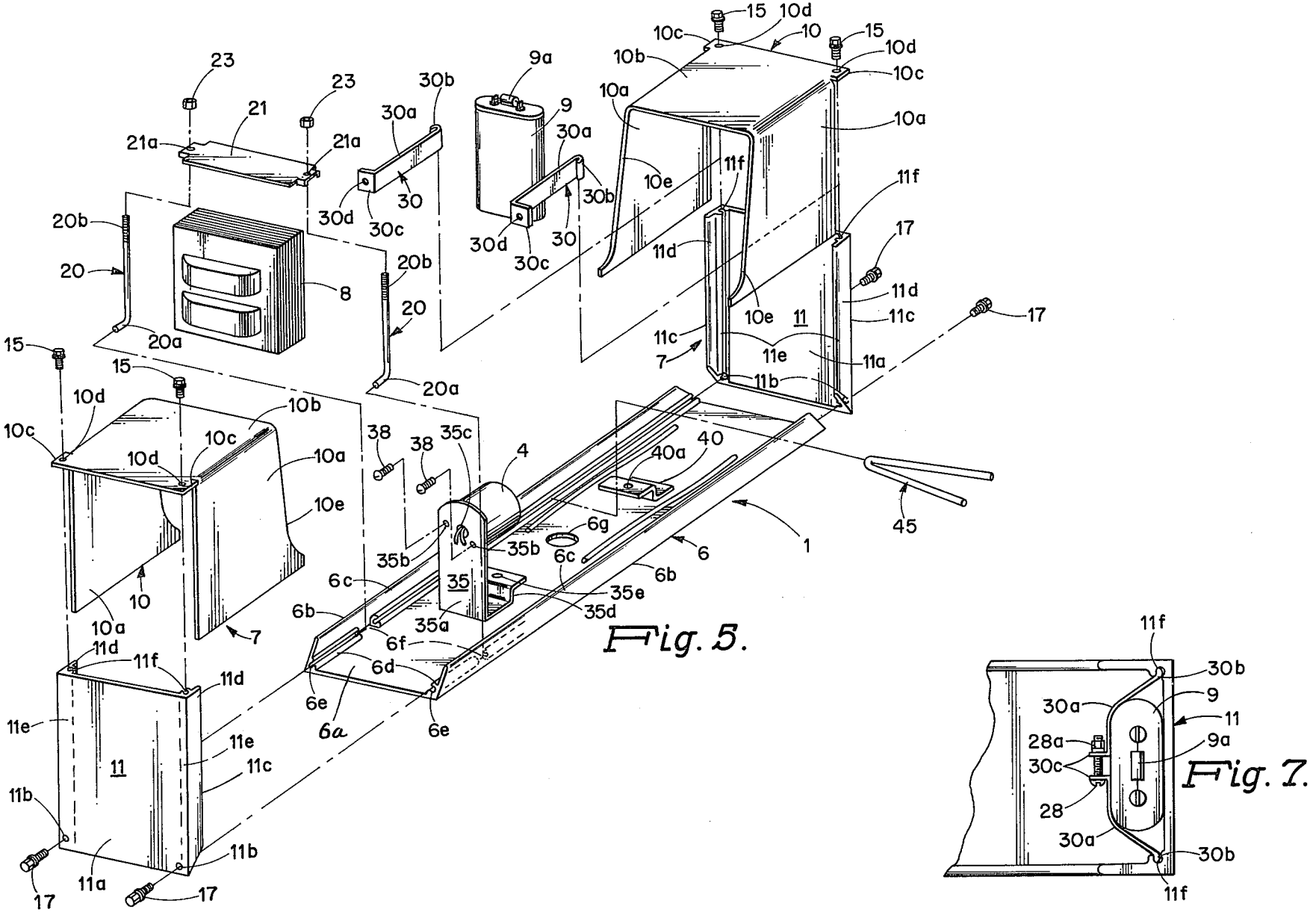
FIG. 5 is an exploded perspective view of a housing assembly and lamp socket arrangement included in the lighting fixture of the invention and the manner in which a power supply ballast transformer, capacitor and resistor are mounted within the housing assembly.
FIG. 7 is a view illustrating the power supply capacitor as mounted within the housing assembly of the lighting fixture of the invention.
Figure 6:
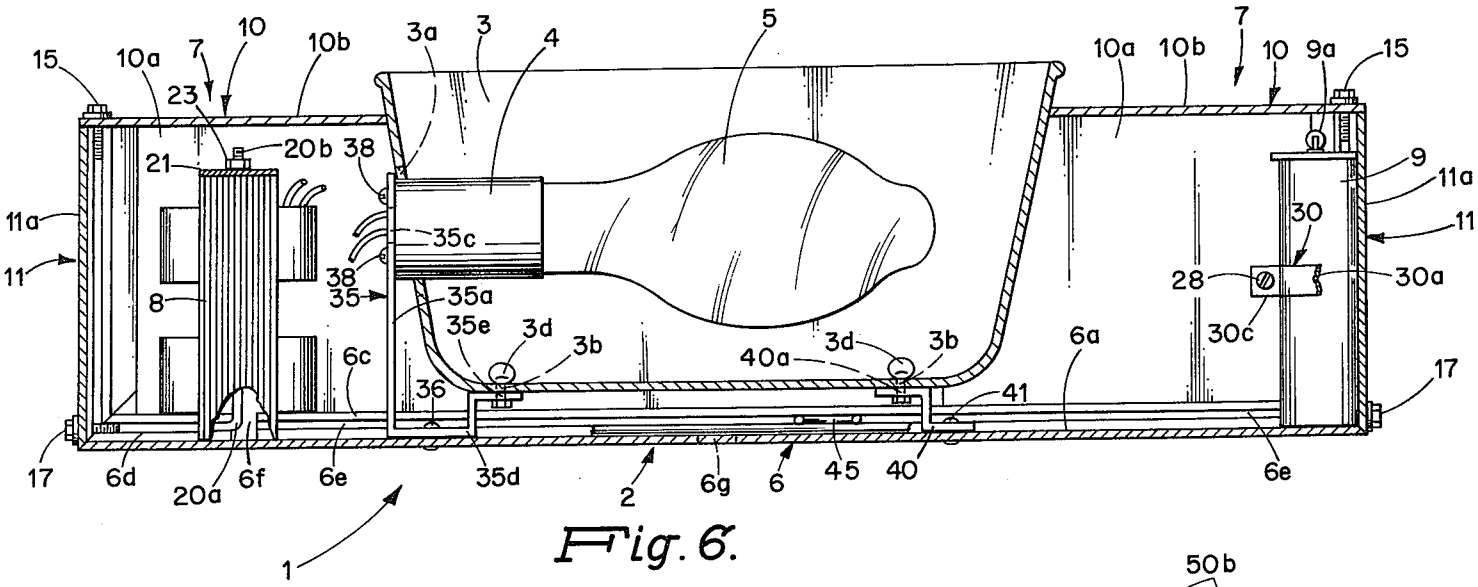
FIG. 6 is a cross-sectional view of the lighting fixture of the invention as taken along line 6—6 of FIG. 3.

The housing assembly 2 is shown in detail in FIGS. 5 and 6 and includes a base member 6 and a pair of opposed end sections 7 attached to the base member 6 at opposite ends of the base member 6. The base member 6, typically of extruded metal, comprises a flat portion 6*a* having a central opening 6*g* therein and a pair of horizontal side channel portions 6*b* extending upwardly from the side edges of the flat portion 6*a* and each including a guide portion 6*c* and a C-shaped portion 6*d* defining an elongated channel slot 6*e*. The purpose of the side channel portions 6*c* will be described in detail hereinafter. The central opening 6*g* is used for the passage of wiring external to the fixture 1 to the interior of the fixture 1 to be then joined with wiring associated with the electrical components of the fixture 1, specifically, the power supply components of the fixture 1.

The aforementioned end sections 7 are employed in accordance with the present invention to contain the power supply components for the fixture 1. More particularly, and as best indicated in FIGS. 5 and 6, the left-hand end section 7 as shown in the figures is arranged to contain a power supply ballast transformer 8 for the fixture 1 and the right-hand end section 7 as shown in the figures is arranged to contain a power supply ballast capacitor 9 and an associated resistor 9*a* for the fixture 1. Each of the end sections 7 comprises an end cover 10 and an end cap 11. The end cover 10, typically of stamped metal, includes a pair of flat opposed side portions 10*a* and a flat portion 10*b* extending between and integral with the side portions 10*a*. The portion 10*b* further has a pair of tabs 10*c* formed at a pair of adjacent corners thereof, each of the tabs 10*c* having an opening 10*d* therein.

The end cap 11, typically of extruded metal, includes a flat end portion 11*a* having openings 11*b* at a pair of adjacent corners thereof and a pair of vertical side channel portions 11*c* extending away from the side edges of the end portion 11*a* and each including a guide portion 11*d* and a C-shaped portion 11*e* defining an elongated channel slot 11*f*. The end cover 10 and the end cap 11 are secured to each other to form the end section 7 by means of a pair of threaded bolts 15 which are inserted through the openings 10*d* in the tabs 10*c* of the end cover 10 and threaded into the channel slots 11*f* in the channel portions 11*c* of the end cap 11. It will be noted that the channel slots 11*f* in the channel portions 11*c* are initially unthreaded but threads are formed therein as the threaded bolts 15 are threaded into the channel slots 11*f*. The guide portions 11*d* of the end cap 11 serve to guide the side portions 10*a* of the end cover 10 during the above-described assembly operation and further serve to contain the end cover 10 between the guide portions 11*d*. Each of the end sections 7 as described hereinabove is attached to the base member 6 by means of a pair of threaded bolts 17 inserted through the openings 11*b* in the end cap 11 and threaded into the channel slots 6*e* of the channel portions 6*b* of the base member 6. As in the case of the channel openings 11*f* of the end cap 11, the channel slots 6*e* of the base member 6 are also initially unthreaded but threads are formed therein as the threaded bolts 17 are threaded into the channel slots 6*e*. The guide portions 6*c* of the base member 6 serve to guide the side portions 10*a* of the end covers 10 during the attachment of the end sections 7 to the base member 6 and further serve to contain the end sections 7 between the guide portions 6*c*.

The manner in which the ballast transformer 8 and the ballast capacitor 9 and resistor 9*a* are mounted within the left-hand and right-hand end sections 7 of the lighting fixture 1 is shown in FIGS. 5–7. As indicated in FIG. 5, the ballast transformer 8 is mounted to the base member 6, to be then located within the left-hand end section 7, by means including a pair of L-shaped bolts 20 having horizontal and vertical portions 20*a* and 20*b*, respectively, and by means of a ballast clamp 21. More particularly, the horizontal portions 20*a* of the L-shaped bolts 20 are inserted into small openings 6*f* cut into the elongated channel slots 6*e* and made to lie along the paths or axes of the channel slots 6*e*. The horizontal portions 20*b* of the L-shaped bolts 20, the ends of which are threaded, are then inserted through openings 21*a* in the ballast clamp 21 and the ballast clamp 21 made to lie across the top of the laminated metal core portion of the ballast transformer 8. A pair of nuts 23 are then threaded onto the threaded ends of the horizontal portions 20*a* of the L-shaped bolts 20 and tightened until the ballast transformer 8 has been secured against the base member 6.

The ballast capacitor 9 and the resistor 9*a* are mounted within the right-hand end section 7, prior to the end cover 10 and the end cap 11 of that end section being assembled together as previously described, by means of a pair of straps 30. As shown in FIG. 5, each of the straps 30 has a flat central portion 30*a*, a generally C-shaped curved portion 30*b* at one end of the central portion 30*a* and a flat portion 30*c* normal to the other end of the central portion 30*a* and having an opening 30*d* therein. To mount the capacitor 9 (and associated resistor 9*a*) within the right-hand end section 7, the curved end portions 30*b* of the straps 30 are manipulated into the elongated channel slots 11*f* of the end cap 11 of that section and the capacitor 9 (with the associated resistor 9*a*) is placed between the straps 30 in abutment with the inner surface of the end portion 11*a* of the end cap 11. The straps 30 are then bent or wrapped around the front of the capacitor 9 until the flat portions 30*c* of the straps 30 are essentially parallel to each other and the straps 30 embrace and capture the capacitor 9 against the inner surface of the end portion 11*a* of the end cap 11 as shown, for example, in FIG. 7. A threaded bolt 28 (FIG. 7) is then inserted through the openings 30*d* in the flat portions 30*c* of the straps 30 and threaded into an associated nut 28*a* (FIG. 7) until the capacitor 9 is held tightly in place against the inner surface of the end portion 11*a* of the end cap 11.

Figure 8:
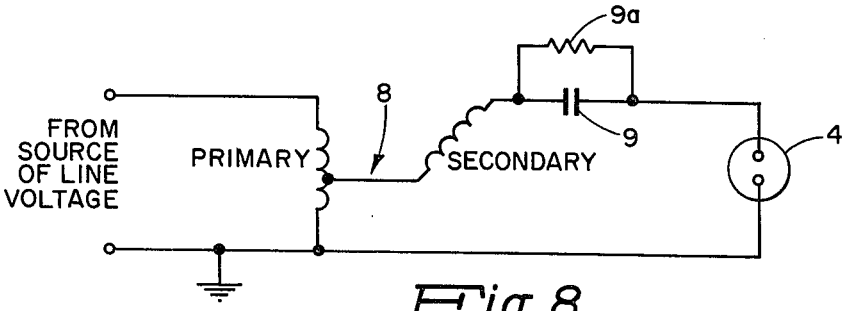
FIG. 8 is a schematic diagram illustrating an exemplary wiring arrangement for the electrical components of the lighting fixture of the invention.

The aforementioned lamp socket 4 is properly positioned with respect to the base member 6 so as to receive a lamp 5 by means of a bracket 35. As indicated in FIG. 6, the bracket 35 is secured to the base member 6 by means of a rivet 36 and includes a flat vertical portion 35*a* having openings 35*b* and 35*c* therein and an essentially Z-shaped portion 35*d* integral with the vertical portion 35*a* and having a threaded opening 35*e* therein. The openings 35*b* are adapted to receive a pair of threaded bolts 38 for securing the lamp socket 4 to the bracket 35 and the opening 35*c* is provided for the passage of wires from the lamp socket 4 to be connected to the power supply components for the fixture 1, that is, to the ballast transformer 8, the ballast capacitor 9 and the resistor 9*a*. An exemplarly wiring arrangement for the ballast transformer 8, the ballast capacitor 9, the resistor 9*a* and the lamp socket 4 is shown in FIG. 8.

Figure 9:
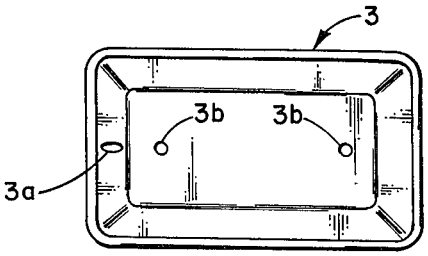
FIG. 9 is a top view of a reflector employed in the lighting fixture of the invention.

The Z-shaped portion 35*d* of the bracket 35 is employed together with a similar Z-shaped member 40, secured to the base member 6 by means of a rivet 41 (FIG. 6), to mount the aforementioned reflector 3 to the base member 6. More particularly, after the lamp socket 4 has been inserted through the opening 3*a* in the reflector 3 so as to enter into the interior of the reflector 3, a pair of threaded bolts 3*d* such as standard thumb-type bolts (FIG. 6) are simply inserted through corresponding openings 3*b* in the reflector 3 (see FIG. 9) and threaded into the threaded opening 35*e* of the Z-shaped portion 35*d* of the bracket 35 and into a similar threaded opening 40*a* in the Z-shaped member 40. A lamp 5 as shown in FIGS. 1–4 may then be inserted into the lamp socket 4. The above-described reflector 3 may be of metal with a porcelain enamel coating and have a generally-rectangular or tub-like configuration. It will be noted in this latter respect and as best shown in FIGS. 1–5 that the opposed side portions 10*a* of the end covers 10 have edge surfaces 10*e* (FIG. 5) facing the center of the fixture 1 which are curved slightly to conform to the outside contour of the opposing side walls of the reflector 3. As a result, dust or other foreign matter is prevented from entering either of the end sections 7.

The aforedescribed elongated channel slots 6*e* of the base member 6 are also used to establish and orient the path of wiring used in conjunction with the ballast transformer 8 and the ballast capacitor 9. Desirably, this wiring should be arranged within the fixture 1 to have a flat-form profile so as not to interfere with the other parts of the fixture 1, particularly when the fixtue 1 is used in a direct lighting application as shown in FIGS. 1 and 2. As shown in FIGS. 5 and 6, a generally U-shaped wire retaining clip 45 is placed over the wiring with the U-portion of the wire retaining clip 45 being inserted within one of the elongated channel slots 6*e* of the base member 6 and the free ends of the wire retaining clip 45 being inserted within the other of the elongated channel slots 6*e* of the base member 6. As a result, the wiring is retained flatly in position, specifically, either over (FIGS. 1 and 2) or under (FIGS. 3 and 4) the reflector 3, and prevented from interfering with the other parts of the fixture 1 or their assembly.

Figure 10:
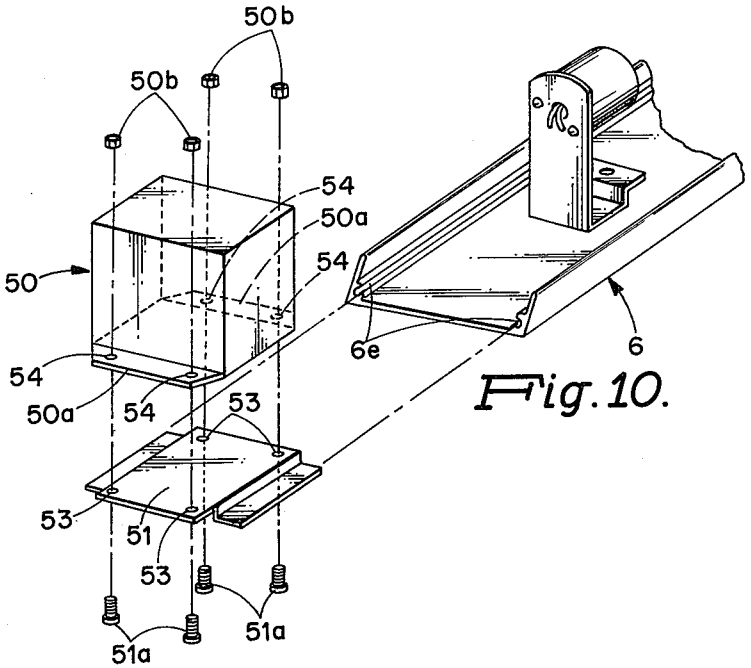
FIG. 10 illustrates an alternative arrangement for mounting a power supply ballast transformer within the housing assembly of the lighting fixture of the invention.

Referring now to FIG. 10 there is shown an alternative arrangement by which a power supply ballast transformer 50 of a design differing from the aforedescribed transformer 8 may be mounted within the left-hand end section 7 of the lighting fixture 1. As shown in FIG. 10, the alternative mounting arrangement includes a transformer support tray 51 having a plurality of openings 53 therein. The ballast transformer 50 is securely mounted to the support tray 51 by means of a plurality of threaded bolts 51*a* which are inserted into the openings 53 in the support tray 51, openings 54 in flanges 50*a* of the transformer 50, and then threaded into associated nuts 50*b*. The support tray 51 with the transformer 50 secured thereto may then be slidably and tightly inserted into the opposed channel slots 6*e* of the base members 6 and retained in position within the channel slots 6*e*.

It will now be obvious that the above-described lighting fixture 1, by virtue of its use of the end sections 7 and the reflector 3 therebetween, all arranged linearly with respect to each other and closely with the base member 6 of the fixture 1, establishes a low profile for the fixture 1 and renders the fixture 1 particularly suitable for low and medium height mounting installations. The low profile of the fixture 1 is further enhanced by the use of the horizontally-oriented lamp socket 4 and the horizontally-oriented lamp 5. In addition, the ballast transformer 8 and the ballast capacitor 9 (and resistor 9*a*) are neatly and conveniently housed within the end sections 7, with the ballast transformer 8 being spaced away from the lamp 5 so as not to interfere with the lamp 5 or its operation when heat is generated by the ballast transformer 8 in the normal course of its operation. The wiring associated with the ballast transformer 8 and the ballast capacitor 9 is further maintained in a flat, non-interfering, compact position. Finally, the elongated channel slots 6*e* and 11*f* in the base member 6 and in the end caps 11, respectively, greatly facilitate the assembly of the housing assembly 3 of the fixture 1 and allow the ballast transformer 8 and the ballast capacitor 9 (and resistor 9*a*) to be mounted within their respective end sections 7 using simple readily-assembled components.

While there has been described what is considered to be a preferred embodiment of the invention, it will be obvious to those skilled in the art that various changes and modifications may be made therein without departing from the invention as called for in the appended claims.

What is claimed is:

1. A low-profile lighting fixture comprising:

a generally-flat base member having a first end and a second end;

a first end section attached to the base member at the first end thereof and defining a first housing;

a power supply ballast transformer contained within the first housing defined by the first end section;

a second end section attached to the base member at the second end thereof and defining a second housing;

a power supply capacitor contained within the second housing defined by the second end section;

a lamp-receiving socket;

mounting means attached to the base member adjacent to one of the end sections and positioning the lamp-receiving socket in a generally horizontal orientation; and a reflector mounted to the base member in a common horizontal plane with the first and second end sections and intermediate to the first and second end sections, said reflector having an opening therein communicating with the interior of the reflector for the projection into the interior of the reflector of the lamp-receiving socket.

2. A low profile lighting fixture comprising:

a generally-flat base member having a first end and a second end;

a first end section attached to the base member at the first end thereof and defining a first housing;

a power supply ballast transformer contained within the first housing defined by the first end section;

a second end section attached to the base member at the second end thereof and defining a second housing;

a power supply capacitor contained within the second housing defined by the second end section;

a lamp-receiving socket;

mounting means attached to the base member adjacent to one of the end sections and positioning the lamp-receiving socket in a generally horizontal orientation; and a reflector positioned in line with the first and second end sections and intermediate to the first and second end sections, said reflector having an opening therein communicating with the interior of the reflector for the projection into the interior of the reflector of the lamp-receiving socket and wherein:

the base member has an elongated flat portion;

the first end section comprises:

a. an end cover having first and second side portions extending away from the flat portion of the base member at the first end thereof and a connecting portion spaced from the flat portion of the base member and bridging the first and second side portions; and b. cap means extending away from the flat portion of the base member and bridging the first and second side portions of the end cover to define, together with said end cover, the first housing for containing the power supply ballast transformer; and the second end section comprises:

c. an end cover having first and second side portions extending away from the flat portion of the base member and the second end thereof, and a connecting portion spaced from the flat portion of the base member and bridging the first and second side portions; and d. cap means extending away from the flat portion of the base member and bridging the first and second side portions of the end cover to define, together with said end cover, the second housing for containing the power supply capacitor.

3. A low-profile lighting fixture in accordance with claim 2 wherein:

the reflector is generally-rectangular in configuration and includes a pair of opposing side walls intermediate to the first and second end sections; and the end covers of the first and second end sections have edge surfaces facing each other which conform to the outer contour of the aforesaid side walls of the reflector, thereby to fully enclose the first and second end sections.

4. A low profile lighting fixture in accordance with claim 2 wherein:

the base member further has channel portions at opposing sides of the flat portion and defining elongated channel slots; and each of the cap means includes a cap member having openings therein aligned with the elongated channel slots defined by the aforesaid channel portions;

said fixture including: threaded fasteners inserted within the openings in the cap members and threaded into the elongated channel slots.

5. A low-profile lighting fixture in accordance with claim 4 wherein:

each of the cap members has a pair of opposing channel portions at the sides thereof defining elongated channel slots; and each of the end covers further includes a pair of tabs extending from the connecting portion thereof and having openings therein aligned with the elongated channel slots of a corresponding pair of the channel portions of the associated cap member;

said fixture further including: threaded fasteners inserted within the openings in the aforesaid tabs and threaded into the elongated channel slots defined by the channel portions of the cap members.

6. A low-profile lighting fixture in accordance with claim 2 wherein:

the base member further has channel portions at opposing sides of the flat portion defining elongated channel slots, said channel portions further having opposed access openings into said channel slots adjacent to the side portions of the end cover to the first end section for providing access into the elongated channel slots:

the power supply ballast transformer is positioned on the flat portion of the base member adjacent to the access openings of the channel portions;

said fixture further including a mounting arrangement for the power supply ballast transformer, said mounting arrangement comprising:

a pair of mounting members having first portions inserted into the channel slots of the base member via the access openings into said channel slots and lying along the axes of said channel slots, and second portions extending from the first portions adjacent to opposite sides of the ballast transformer; and connecting means overlying the ballast transformer and interconnecting the second portions of the mounting members to cause the ballast transformer to be held tightly against the flat portion of the base member.

7. A low-profile lighting fixture in accordance with claim 6 wherein:

the mounting members are essentially L-shaped bolts, the first and second portions of the mounting members corresponding, respectively, to the horizontal and vertical portions of the L-shaped bolts.

8. A low-profile lighting fixture in accordance with claim 7 wherein:

the vertical portions of the L-shaped bolts have threaded sections therealong;

the connecting means includes:

a clamp overlying the ballast transformer and having openings therein through which the vertical portions of the L-shaped bolts are arranged to pass; and nuts threaded onto the threaded sections of the vertical portions of the L-shaped bolts to arrange the clamp and the vertical portions of the L-shaped bolts with respect to each other to cause the ballast transformer to be held tightly against the flat portion of the base member.

9. A low-profile lighting fixture in accordance with claim 2 wherein:

the base member further has channel portions at opposing sides of the flat portion defining elongated channel slots; and said fixture further including a mounting arrangement for the power supply ballast transformer, said mounting arrangement comprising:

a support tray slidably positioned within the channel slots of the channel portions of the base member intermediate to the first and second slide portions of the end cover of the first end section; and means securing the ballast transformer to the support tray.

10. A low-profile lighting fixture in accordance with claim 2 wherein:

the cap means of the second end section includes a cap member having an inner surface and a pair of channel portions at the sides of the inner surface thereof defining elongated channel slots; and the power supply capacitor is positioned against the inner surface of the cap member;

said fixture further including a mounting arrangement for the power supply capacitor, said mounting arrangement comprising:

strap means having portions positioned within the channel slots of the cap member and portions capturing the capacitor against the inner surface of the cap member to cause said capacitor to be held tightly against the inner surface of the cap member.

11. A low-profile lighting fixture in accordance with claim 10 wherein the strap means comprises:

a pair of straps having first and second portions positioned within the channel slots of the cap member, central portions integral with the first end portions and partially embracing the capacitor, and second end portions integral with the central portions; and adjustable means adjustably interconnecting the second end portions of the pair of straps to cause the capacitor to be captured against the inner surface of the cap member and to be held tightly against the inner surface of the cap member.

12. A low-profile lighting fixture in accordance with claim 2 wherein:

the base member further has channel portions at opposing sides of the flat portion and defining channel slots; and the power supply ballast transformer and capacitor have wiring associated therewith disposed along the flat portion of the base member between the channel portions;

said fixture further including a retaining member overlying the aforesaid wiring and having portions disposed within the channel slots of the channel portions.

13. A low-profile fixture in accordance with claim 12 wherein:

the retaining member is a generally U-shaped member with the U-portion thereof being disposed in one of the channel slots and the free ends thereof being disposed in the other channel slot.

14. A low-profile fixture in accordance with claim 2 wherein:

the base member further has channel portions at opposing sides of the flat portion and defining elongated channel slots, said channel portions further having opposed access openings into said channel slots adjacent to the side portions of the end cover of the first end section for providing access into the channel slots;

the power supply ballast transformer is positioned on the flat portion of the base member adjacent to the access openings of the channel portions;

the cap means of the second end section includes a cap member having an inner surface and a pair of channel portions at the sides of the inner surface thereof defining elongated slots;

the power supply capacitor is positioned against the inner surface of the cap member;

said fixture further including a mounting arrangement for the power supply ballast transformer, said mounting arrangement comprising:

a pair of mounting members having first portions inserted into the channel slots of the base member via the access openings into said channel slots and lying along the axes of said channel slots, and second portions extending from the first portions adjacent to opposite sides of the ballast transformer; and connecting means overlying the ballast transformer and interconnecting the second portions of the mounting members to cause the ballast transformer to be held tightly against the flat portion of the base member; and said fixture further including a mounting arrangement for the power supply capacitor, said mounting arrangements comprising:

strap means having portions positioned within the channel slots of the cap member of the second end section and portions capturing the capacitor against the inner surface of the cap member to cause said capacitor to be held tightly against the inner surface of the cap member.

15. A low profile fixture in accordance with claim 2 wherein:

the base member further has channel portions at opposing sides of the flat portion and defining elongated channel slots;

the cap means of the second end section includes a cap member having an inner surface and a pair of channel portions at the sides of the inner surface thereof defining elongated channel slots;

said fixture further including a mounting arrangement for the power supply ballast transformer, said mounting arrangement comprising:

a support tray slidably positioned within the channel slots of the channel portions of the base member intermediate to the first and second side portions of the end cover of the first end section; and means securing the ballast transformer to the support tray; and said fixture further including a mounting arrangement for the power supply capacitor, said mounting arrangement comprising:

strap means having portions positioned within the channel slots of the cap member of the second end section and portions capturing the capacitor against the inner surface of the cap member to cause said capacitor to be held tightly against the inner surface of the cap member.

16. A low-profile lighting fixture in accordance with claim 15 wherein:

the reflector is generally-rectangular in configuration and includes a pair of opposing side walls intermediate to the first and second end sections; and the end covers of the first and second end sections have edge surfaces facing each other which conform to the outer contour of the aforesaid side walls of the reflector, thereby to fully enclose the first and second end sections.

* * * * *